US006089944A

United States Patent [19]

Bergkvist

[11] Patent Number: 6,089,944

[45] Date of Patent: Jul. 18, 2000

[54] TOY

[75] Inventor: Håkan Bergkvist, Bromma, Sweden

[73] Assignee: Baby Björn AB, Täby, Sweden

[21] Appl. No.: 09/147,243

[22] PCT Filed: Sep. 4, 1997

[86] PCT No.: PCT/SE97/01476

§ 371 Date: Nov. 12, 1998

§ 102(e) Date: Nov. 12, 1998

[87] PCT Pub. No.: WO98/10850

PCT Pub. Date: Mar. 19, 1998

[30] Foreign Application Priority Data

Sep. 13, 1996 [SE] Sweden ..... 9603335

[51] Int. Cl.[7] ..... A63H 33/00; A63H 33/08

[52] U.S. Cl. ..... 446/227; 446/124

[58] Field of Search ..... 446/46, 85, 97, 446/99, 103, 120, 124, 227, 491; 473/437

[56] References Cited

U.S. PATENT DOCUMENTS

| | | | |
|---|---|---|---|
| 2,397,061 | 3/1946 | Toalson . | |
| 3,521,883 | 7/1970 | Hamilton | 473/437 |
| 4,893,809 | 1/1990 | Blankenzee | 272/114 |
| 5,045,011 | 9/1991 | Lovik | 446/46 |
| 5,050,877 | 9/1991 | Wales | 473/437 |
| 5,395,107 | 3/1995 | De Pippo | 473/437 |

FOREIGN PATENT DOCUMENTS

| | | |
|---|---|---|
| 1172565 | 2/1967 | United Kingdom . |
| 1306039 | 2/1973 | United Kingdom . |

*Primary Examiner*—Kien T. Nguyen
*Assistant Examiner*—Laura Fossum
*Attorney, Agent, or Firm*—Jacobson, Price, Holman & Stern, PLLC

[57] ABSTRACT

A toy that includes at least one component that has a central part and a peripheral part that surrounds the central part and has a small thickness in comparison with the central part. The parts comprise a separate central part and a separate peripheral part that embraces the separate central part and is connected thereto. The separate peripheral part is comprised of a material which is tougher than the material from which the central part is made.

15 Claims, 3 Drawing Sheets

Fig. 1
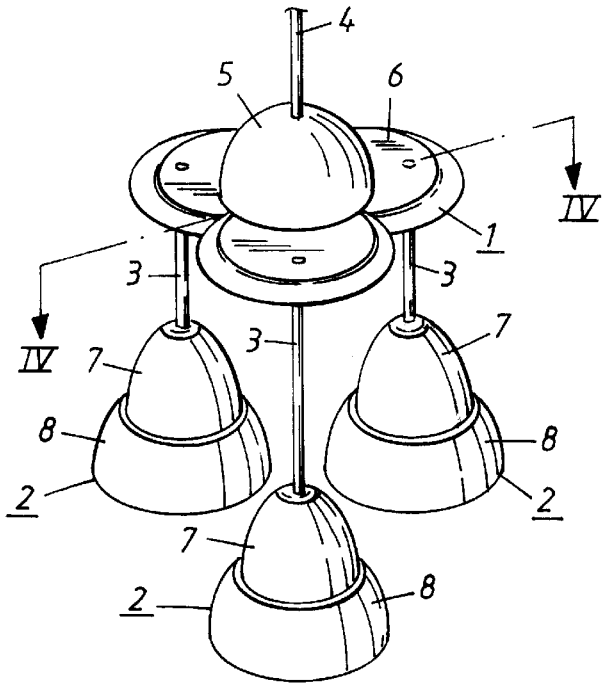
Fig. 2
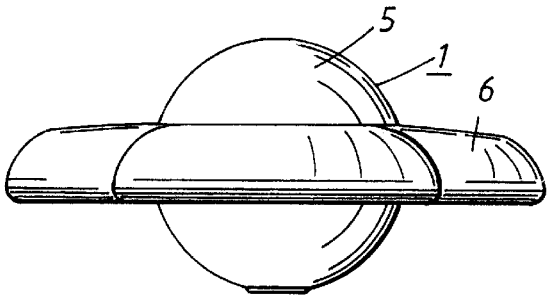
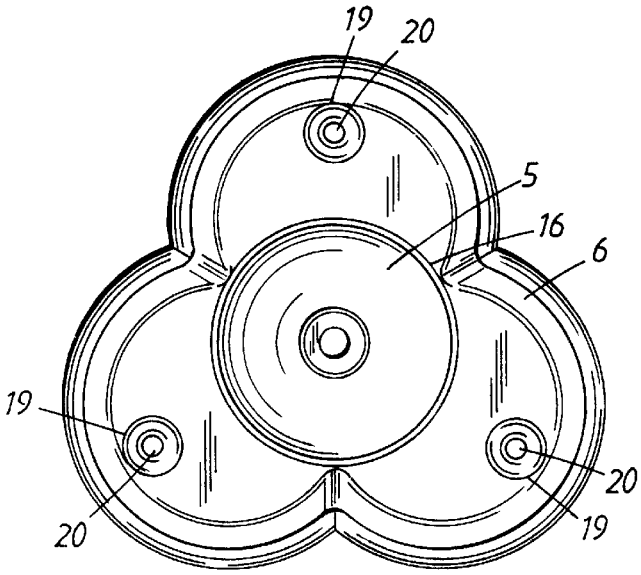
Fig. 3

TOY

BACKGROUND OF THE INVENTION

1. Field of the Invention

The present invention relates to a toy or plaything that includes at least one component which has a central part and a peripheral part which surrounds said central part and which has a small thickness in comparison with the thickness of said central part.

2. Description of the Related Art

Toys or playthings of this kind, for instance in the form of a bell that includes an integrated skirt-like part of comparatively small wall thickness, are known to the art. Two or more such bells may be included as components in a toy for babies or infants, where each of the bells is connected to a bite-friendly ring for instance by means of a band to form a rattle or a so-called roof in the form, e.g., of a disc whose thickness decreases towards the disc periphery and from which the bells hang when the disc is, in turn, hung from a cord or line stretched between the sides of the hood of a baby carriage, or perambulator, or from the sides of a cot. Toys and playthings of this kind are advantageous, inter alia, for training the vision and gripping ability of babies, or infants, and are very popular both with parents of babies and older people, especially when the toys are made of wood. However, certain load tests carried out on such toys and playthings have shown that they could break into pieces that are small enough to be swallowed by a baby, therewith causing injury to the child or causing the child to choke.

SUMMARY OF THE INVENTION

The object of the present invention is to provide novel and improved toys of the aforesaid kind with which the above-mentioned problems are avoided.

To this end, it is proposed in accordance with the invention that the aforementioned parts of a toy or plaything of the kind defined in the introduction include a separate central part and a separate peripheral part which surrounds the central part and is connected thereto and which is comprised of a tougher material than the separate central part. This arrangement enables the requirement of high mechanical strength to be readily satisfied while enabling the traditional and popular basic configuration of such playthings to be essentially maintained.

According to the invention, the peripheral part may conveniently be constructed to exert an inwardly acting force against the central part, so as to support said part and exert an integrating or binding force thereon. The central part and the peripheral part of the toy may conveniently be interlocked mechanically in the axial direction, for instance by means of an all-round groove in one part that receives a ridge or projection on the other part.

The central part may typically be made of wood, so as to give traditional expression to the toy or plaything, while the outer, surrounding part may conveniently be made of a tough plastic material, and both parts may be made in harmonizing and attractive colors. The central part of the toy may be lacquered or glazed in a manner to show or set off the grains in the wood. The central part of the toy is preferably rotationally symmetrical about a center axis that extends generally parallel with the grain of the wood. This shape can be easily achieved in a wood lathe, and splintering of the wood is effectively prevented by virtue of the central part being held together by the forces exerted thereon by the peripheral part at right angles to the grain of the wood.

The peripheral part conveniently includes an axially angled collar which embraces the outermost radial region of the central part while exerting a radially inwardly acting pressure thereon. This protects the central part in a favorable manner. In order to impart favorable firmness or stability to the peripheral part of the toy and also to hide the collar, which is beneficial from the aspect of appearance, the collar may conveniently extend downwards in relation to the peripheral part of the toy.

In the manufacture of a bell-like toy or plaything, it is suitable to ensure that the central part has a paraboloidal shape and is terminated at its bottom by a transverse surface, the central part being embraced in its bottom region by a skirt-like peripheral part whose collar, which lies against the central part under pressure, reaches at least down to the transverse terminating surface on the central part. This effectively obviates the risk of portions of the central part splitting at the abrupt transition between the mantle surface thereof and its transverse terminating surface.

In order to ensure that a baby or infant will be unable to swallow the central part in the unlikely event of the central part loosening from the peripheral part despite the safe design of the inventive toy, it will preferably be seen that the central part has a largest transverse measurement of at least 32 mm.

BRIEF DESCRIPTION OF THE DRAWINGS

The invention will now be described in more detail with reference to the accompanying drawings, which illustrate exemplary embodiments of different toy components and in which FIG. 1 is a perspective illustration of an inventive toy or plaything;

FIG. 2 is a side view of a first component of the toy composition shown in FIG. 1;

FIG. 3 shows the component in FIG. 2 from beneath;

DETAILED DESCRIPTION OF THE PREFERRED EMBODIMENTS

Figure 4:
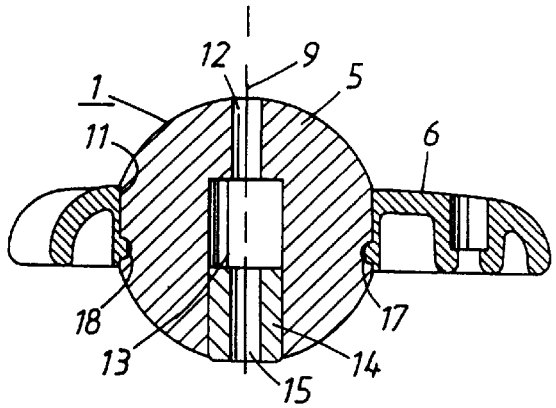
FIG. 4 is a sectioned view of the first component, taken on the line IV—IV in FIG. 1.

Those components of the toy that find correspondence in the various illustrations have been identified with the same reference signs.

The toy illustrated in FIG. 1 includes two types of components, namely a so-called roof 1 and three bell-like components 2 that hang from the roof 1 on lines 3. As indicated, the roof 1 is, in turn, intended to be suspended from a line or corresponding device stretched between two sides of a baby carriage hood or two sides of a cot (not shown).

The roof 1 is comprised of a separate, central part 5 and a separate peripheral part 6 which embraces the central part 5 and has a thinner material thickness than the central part 5. The peripheral part 6 is joined to the central part 5 and is made of a tougher material than the central part 5. The central part is preferably comprised of wood and the peripheral part 6 of an impact resistant or tough plastic material. Correspondingly, the bell-like components 2 each consists of a central part 7, suitably made of wood, and a part 8 connected to the central part 7, which is suitably made of tough, impact-resistant plastic and has a comparatively small thickness.

The central parts 5 and 7 have a largest size of at least 32 mm in cross-section so that said parts will be too large to pass down into the pharynx or windpipe of a baby. In the illustrated embodiment, the central parts 5 and 7 are rotationally symmetrical about a respective axis 9 and 10 and can have been machined from wood on a lathe, it being ensured that the grain of the wood extends parallel with the associated symmetry axis.

As will be evident from FIGS. 1–4, the central part 5 of the roof 1 has an essentially spherical shape, although the sides of said part have been planed to an outer cylindrical shape in the abutment region 11 with the peripheral part 6 (FIG. 4). In its position of use, the central part 5 has a vertical through-penetrating bore 12 which has a widened region 13 for accommodating and fixing a knot tied on the bottom of the line 4. A plug or stopper 14 is fixed in the bottom part of the widened region 13 and, in turn, includes a bore 15 through which there can be passed a line (not shown) for carrying a further component of the toy or plaything, for instance a teething ring or the like.

Figure 5:
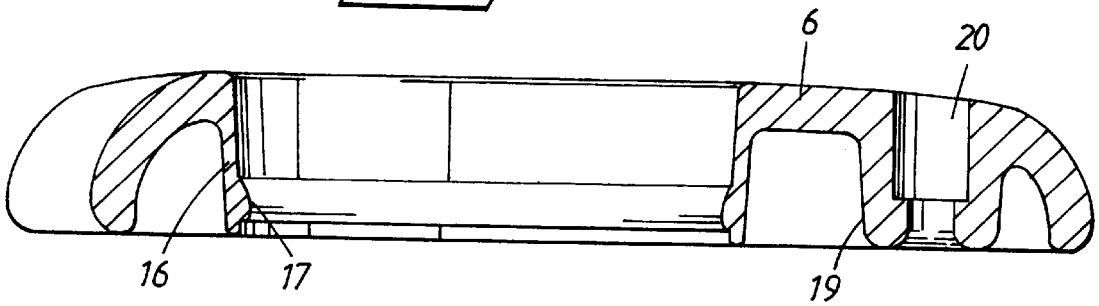
FIG. 5 illustrates the peripheral part of the component shown in FIG. 4 in larger scale.
Figure 6:
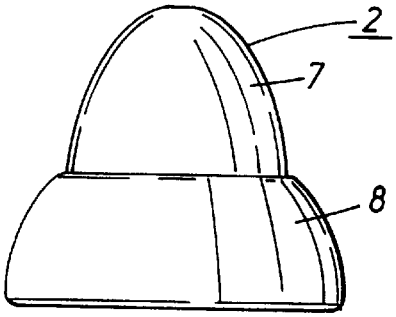
FIG. 6 is a side view of a second component of the toy composition shown in FIG. 1.
Figure 7:
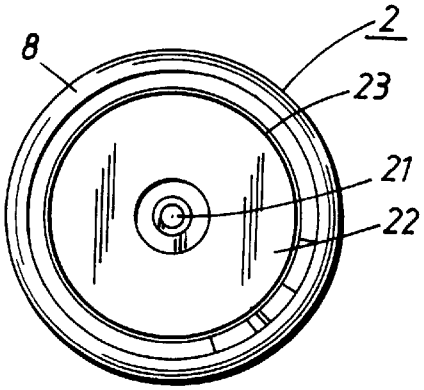
FIG. 7 shows the component in FIG. 6 from beneath.
Figure 8:
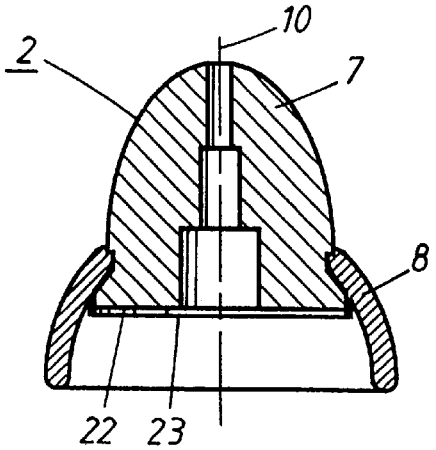
FIG. 8 is an axial sectional view of the second component.
Figure 9:
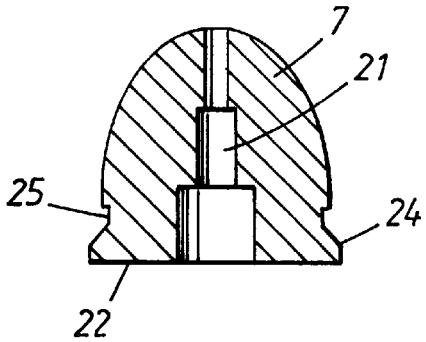
FIG. 9 is an axial sectioned view of solely the central part of the second component.
Figure 10:
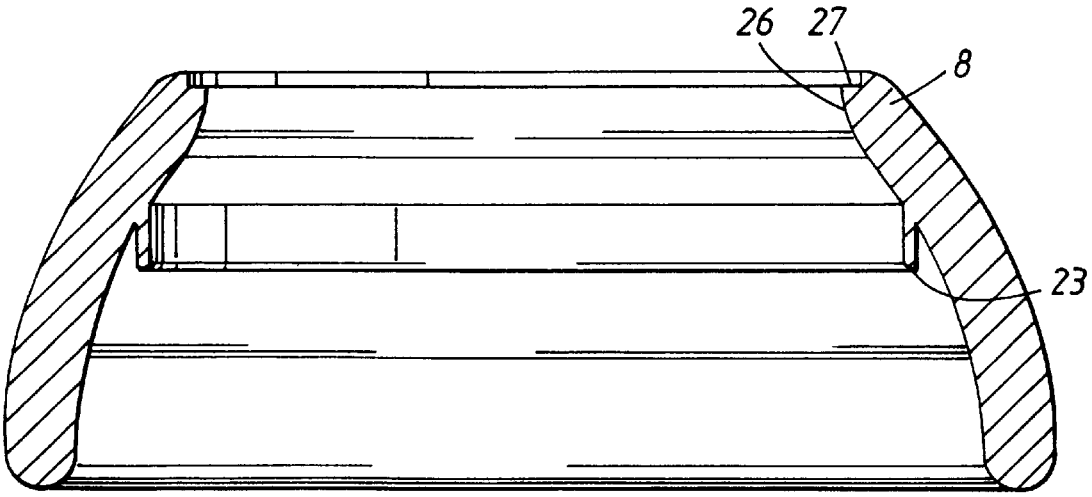
FIG. 10 is an enlarged axial sectioned view of solely the peripheral part of the second component.

The peripheral part 6 of the illustrated embodiment has the general shape of a three-leaf clover and has a central opening that accommodates the central part 5. This opening is surrounded by a downwardly extending collar 16 which is formed in the part 6 and which can converge downwardly in the manner shown in FIG. 5 so that after being fitted on the part 5 from beneath, the collar will exert pressure on the central part in the region 11. Provided on the inner surface of the collar is a circumferentially extending ridge-shaped projection 17 which is intended to be received in a circumferentially extending groove 18 in the part 5, so as to mechanically lock the parts 5 and 6 together. The peripheral part 6 will preferably have a relatively thin wall and downwardly curved edges.

The peripheral part 6 includes three thickened portions 19 in which through-penetrating bores 20 are provided for the lines 3 shown in FIG. 1, said lines being knotted at their upper ends and received in an upper widened part of associated bores 20 in a known manner.

The bell-like components 2 of the embodiment illustrated in FIG. 6–10 have a generally paraboloidal central part 7 that includes an axially through-penetrating bore 21 and a flat transverse underside 22. The bore 21 includes a widened intermediate part for accommodating a knot on the bottom end of an associated line 3, and a further widened bottom part for receiving a closure plug or stopper (not shown). The peripheral part 8 has the form of an outwardly and downwardly extending skirt of circular cross-section and relatively small material thickness. Provided on the inside of the skirt part 8 is a downwardly facing collar 23. The radially outermost region 24 of the part 7 includes a circumferentially extending groove 25 which is intended to receive an upper, radially inwardly facing and circumferentially extending portion 26 of the part 8. When fitting the part 8 to the part 7 from above, a radial edge 27 will snap-in behind a corresponding edge in the groove 25 so as to mechanically interlock the parts 7, 8. The dimensions of the upper portion 26 of part 8 and the collar 23 in relation to the outermost region 24 of part 7 is such that the collar 23 will lie against the region 24 and extend slightly beneath the surface 22 subsequent to assembling the parts 7, 8, such that part 8 is prevented from further downward movement in relation to part 7.

It will be understood that the invention is not restricted to the described and illustrated exemplifying embodiments thereof and can be implemented in any desired manner within the scope of the inventive concept as defined in the following claims.

What is claimed is:

1. A toy suitable for a baby that includes at least one component that has a central part and a peripheral part which surrounds the central part and has a small thickness in comparison with said central part, said peripheral part embracing said central part and being connected thereto and comprised of a plastic material which is tougher than a wood from which the central part is made, a bottom region of said central part including a peripheral groove that accommodates a radially and inwardly directed projection on an inner surface of said peripheral part such that said peripheral part embraces the bottom region of said central part.

2. The toy according to claim 1, wherein the peripheral part embraces the central part while exerting an inwardly acting pressure thereon.

3. The toy according to claim 1, wherein the central part and the peripheral part are interlocked mechanically in an axial direction.

4. The toy according to claim 1, wherein the central part is rotationally symmetrical about an axis that extends generally parallel with a grain of the wood.

5. The toy according to claim 1, wherein the peripheral part includes a generally axially angled collar which surrounds a radially outermost region of the central part while exerting radially and inwardly acting pressure thereon.

6. The toy according to claim 5, wherein the collar extends downward in relation to the peripheral part and includes a radially and inwardly directed projection on an inner surface thereof for engagement with said peripheral groove in said central part.

7. The toy according to claim 1, wherein the central part has a generally paraboloidal shape and is terminated at its bottom by a transverse surface, the peripheral part having a skirt-like shape and reaching at least down to said transverse terminating surface on the central part.

8. A toy that includes a central part and a peripheral part which embraces said central part and has a small thickness in comparison with said central part and is connected thereto and comprised of a plastic material which is tougher than a wood from which said central part is made, said central part being rotationally symmetrical about an axis that extends generally parallel with a grain of the wood, said peripheral part including a generally axially angled collar which surrounds a radially outermost region of said central part while exerting radially and inwardly acting pressure thereon, said collar extending downward in relation to said peripheral part, and said central part including a peripheral groove that accommodates at least one radially and inwardly directed projection on an inner surface of at least one of the collar and the peripheral part.

9. The toy according to claim 8, wherein the central part has a generally paraboloidal shape and is terminated at its bottom by a transverse surface, a bottom region of the central part being surrounded by a skirt-like peripheral part whose collar in pressing engagement with the central part reaches at least down to said transverse terminating surface on the central part.

10. The toy according to claim 9, wherein the central part has a largest cross-sectional size of at least 32 mm.

11. A toy suitable for a baby that includes a central part and a skirt-like peripheral part in pressing engagement with a bottom region of said central part, said peripheral part having a small thickness in comparison with said central part and being connected thereto and comprised of a material which is tougher than a material from which said central part is made, said central part having a generally paraboloidal shape and being terminated at its bottom by a transverse surface, wherein said skirt-like peripheral part reaches at least down to said transverse terminating surface on the central part.

12. The toy according to claim 11, wherein said peripheral part includes a generally axially angled collar which surrounds a radially outermost region of said central part while exerting radially and inwardly acting pressure thereon.

13. The toy according to claim 12, wherein the central part includes a peripheral groove that accommodates a radially and inwardly directed projection on an inner surface of at least one of the collar and said peripheral part.

14. The toy according to claim 11, wherein said central part is made of wood and said peripheral part is made of a tough plastic material.

15. The toy according to claim 11, wherein said central part at a largest point has a cross-sectional size of at least 32 mm.

* * * * *